US005813749A

United States Patent [19]

Sheldon

[11] Patent Number: 5,813,749

[45] Date of Patent: Sep. 29, 1998

[54] SOLAR POWERED MAILBOX INTERNAL LIGHT

[76] Inventor: David W. Sheldon, 14A Mason Rd., Brookline, N.H. 03033

[21] Appl. No.: 772,103

[22] Filed: Dec. 20, 1996

[51] Int. Cl.[6] ..... F21V 33/00

[52] U.S. Cl. ..... 362/155; 362/183

[58] Field of Search ..... 362/155, 183

[56] References Cited

U.S. PATENT DOCUMENTS 4,648,012 3/1987 Pittman ..... 362/155
4,755,915 7/1988 Rogers ..... 362/155
5,066,338 11/1991 Meyers ..... 362/183
5,138,534 8/1992 Wu ..... 362/183
5,253,150 10/1993 Vanni ..... 362/183

*Primary Examiner*—Carroll B. Dority
*Attorney, Agent, or Firm*—Joseph E. Funk

[57] ABSTRACT

This invention is an improvement of an internal lighting system for rural mailboxes. The improvement provides a maintenance-free mailbox internal lighting system by providing a solar cell charging system and rechargeable batteries to the circuitry. The internal light is automatically actuated by the opening of the door. All the components of the internal lighting system are undetectable to the casual observer to provide a degree of protection from vandalism or theft.

14 Claims, 1 Drawing Sheet

SOLAR POWERED MAILBOX INTERNAL LIGHT

BACKGROUND OF THE INVENTION

1. Field of the Invention

This invention pertains generally to all types of rural delivery mailboxes and particularly to an improved internal lighting system which allows a person to view the contents of the mailbox during darkness.

During the time period of late fall through early spring, darkness falls before most people get home from work. This causes a problem for people who live in a rural area that have a roadside mailbox. Due to the darkness, the only way to determine if there is mail in a box is to stick your hand in and search around. The disadvantage of this method is that you may miss mail that is standing on edge or in a far corner of the box. There may even be an unfriendly spider setting up housekeeping just inside the door.

It should be apparent from the foregoing that reaching into a dark mailbox and searching for mail could have unfavorable results.

2. Prior Art

Mailbox internal lighting devices have been developed in the past such as the "Interior light for U.S. mailbox " of Pittman II U.S. Pat. No. 4,648,012, but the lighting system in this device uses a discardable battery which requires periodic changeout as there is no method to keep this battery charged. One of the greatest detriments to any battery operated device is changing the batteries. Most people do not like to be bothered with this task. Also this particular circuit requires that the mailbox be metal to provide one of the current paths for the lighting system.

SUMMARY OF THE INVENTION

With this background of the invention in mind, it is the object of this invention to provide a mailbox with a maintenance free solar powered circuit that automatically illuminates an internal light in the mailbox when the door is opened. This invention can also be supplied as a manually operated light when the unit is supplied in an easily mounted kit form ready to mount on the mailbox of your choice. It is another object of this invention to provide this invention in a form that is undetectable to the passerby. Engineering tests of this invention provided the stimulus to hide the solar panel and associated circuitry to prevent theft and destruction by vandals. It was found that unusual looking mailboxes attract the rath of vandals and thieves much more than standard mailboxes.

The foregoing and other objects of the invention are attained generally by providing a solar panel charged battery source that provides power for an internal mailbox light when the door of the mailbox is opened. The solar panel is hidden inside a plastic tubular form that is utilized as a nameplate that mounts on top of the mailbox. A switch is mounted under the mailbox in such a manner as to change states from off to on when the door of the mailbox is fully opened. This switch is totally hidden from view.

BRIEF DESCRIPTION OF THE DRAWINGS

Other objects and many of the attendant advantages will be readily appreciated as the same becomes better understood by reference to the following detailed description when considered in connection with the accompanying drawings wherein.

DESCRIPTION OF THE PREFERRED EMBODIMENT

Figure 1:
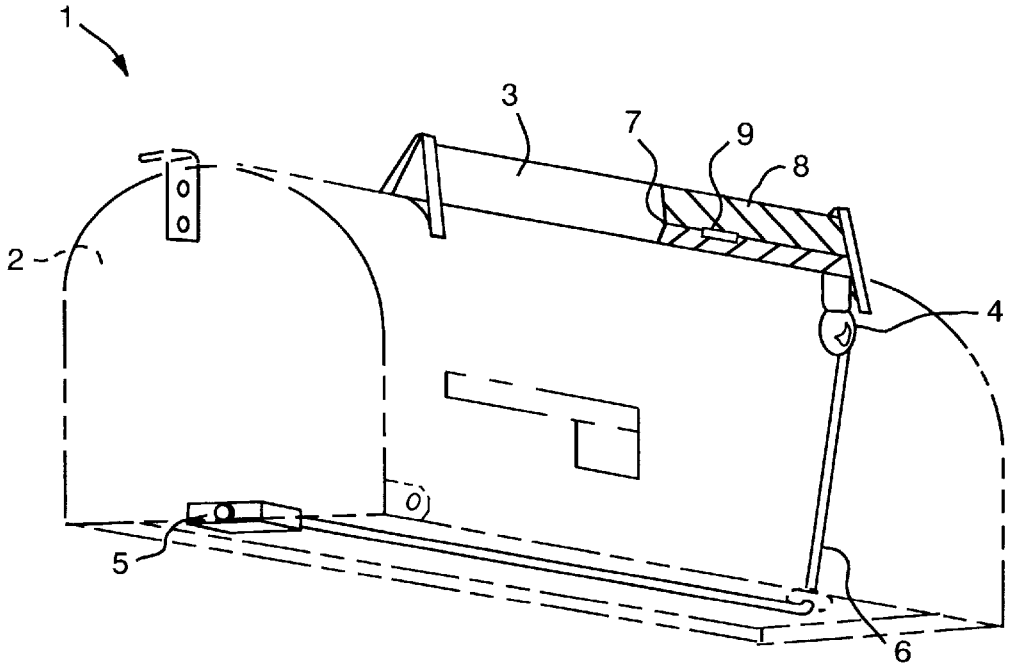
FIG. 1 is a simplified sketch of a mailbox with the solar panel hidden in the nameplate enclosure and an exploded view of the light in the mailbox.

Referring now to FIG. 1, a mailbox modified to a solar powered internal light configuration 1 is shown to comprise a rural U.S. Postoffice approved mailbox 2, a translucent weatherproof nameplate assembly 3, a miniature incandescent light bulb 4, a springloaded normally open single pole switch 5, connecting wires 6, a battery pack 7, a solar panel 8, and a diode 9.

Figure 2:
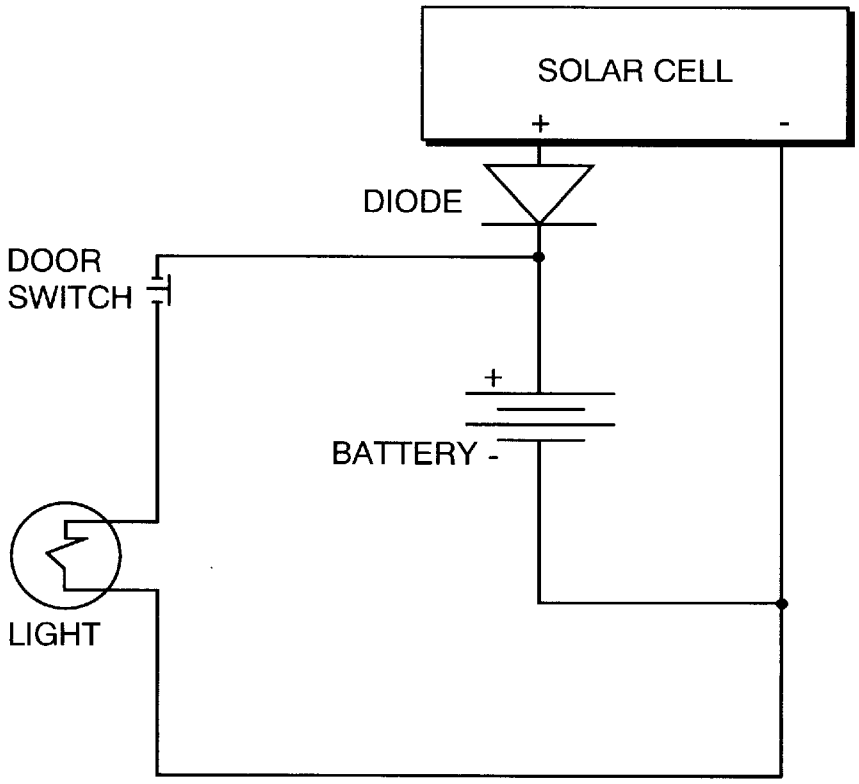
FIG. 2 is an electrical schematic of the lighting circuitry.

With the foregoing in mind and referring to FIG. 1, it may now be seen that when the door of the mailbox 2 is opened approximately 85 degrees, the swinger arm of the switch 5 closes, changing the switch state from open to closed. As shown in FIG. 2, closing of this switch connects one side of the 2.5 volt light 4 to the junction of the positive side of the 2.4 volt battery pack 7 and the negative side of isolation diode 9. When this action occurs, the light 4 illuminates because the negative side of the battery pack 7 is connected to the junction of the other side of the light 4 and the negative side of the solar cell 8, allowing sufficient current to flow from the battery pack 7 through the light 4 to illuminate it. The door of the mailbox 2 can be fully opened without causing damage to the switch 5. When the door is closed, the switch 5 changes states from closed to open at the same position of the door as that when it had been opened (85 degrees). The switch 5 was purposely mounted this way to allow for the door to be left not fully closed, which is something that occurs quite often.

In FIG. 2, it can be seen that the positive terminal of the solar cell 8 is connected to the anode of an isolation diode 9. The cathode of the diode 9 is connected to the junction of the switch 5 and the positive terminal of the battery pack 7. The negative terminal of the solar cell 8 is connected to the junction of the negative terminal of the battery pack 7 and one side of the light 4. It may now be seen that, with switch 5 in the open position, the light 4 will be disconnected from the battery pack 7, allowing the solar cell 8 to provide current to charge the battery pack 7 during daylight hours. This solar cell has the capability to provide 3.0 Volts at a 40 milliampere load. The isolation diode 9 provides a 0.5 volt drop , so the battery pack 7 receives 2.5 volts during the charging phase (3.0 Vdc−0.5 vdc=2.5 Vdc). The Nicad battery pack 7 can sustain voltages as high as 2.8 Vdc with no degradation. The isolation diode 9 is required to prevent the solar cell 8 from discharging the battery pack 7 during hours of darkness when the solar cell 8 output drops to near zero. When the solar cell 8 output voltage decreases below the voltage of the battery pack 7, the diode acts as an open circuit to the charging path.

Referring back to FIG. 1, it may now be seen that the solar cell 8, diode 9, and battery pack 7 have been enclosed within the translucent tubular nameplate cover. This was done to protect the electronic components from the elements as well as vandalism.

I claim:

1. Apparatus for lighting the interior of a mailbox including closure door with an illumination means located in the interior of said mailbox, electrical energy providing means, and means for sensing when said mailbox closure door is opened to enable said electrical energy providing means to provide electrical energy to said illumination means and thereby illuminate the interior of said mailbox, wherein the improvement comprises mounting said sensing means underneath said mailbox adjacent to said closure door so that said sensing means does not enable said electrical energy providing means to provide electrical energy to said illumination means until said closure door is substantially fully opened.

2. The mailbox lighting system of claim 1 further comprising a solar cell that generates electrical energy when light impinges on said solar cell, said solar cell being mounted exterior to said mailbox.

3. The mailbox lighting system of claim 2 wherein said electrical energy providing means comprises means for storing electrical energy, and the electrical energy generated by said solar cell is stored in said electrical energy storing means.

4. The mailbox lighting system of claim 3 further comprising isolation means connected between said solar cell and said means for storing electrical energy to permit electrical energy to flow from said solar cell to said means for storing electrical energy, while preventing electrical energy from flowing back to said solar cell.

5. The mailbox lighting system of claim 4 wherein said isolation means comprises a diode.

6. The mailbox lighting system of claim 5 wherein said means for storing electrical energy comprises a rechargeable battery.

7. The mailbox lighting system of claim 6 wherein said means for sensing when said mailbox closure door is opened is a switch that is operated only when said mailbox closure door is substantially fully opened to connect said means for storing electrical energy to said illumination means to energize same and illuminate the interior of said mailbox.

8. The mailbox lighting system of claim 1 wherein said electrical energy providing means comprises means for storing electrical energy.

9. The mailbox lighting system of claim 8 wherein said means for storing electrical energy comprises a rechargeable battery.

10. The mailbox lighting system of claim 9 wherein said means for sensing when said mailbox closure door is opened is a switch that is operated only when said mailbox closure door is substantially fully opened to connect said means for storing electrical energy to said illumination means to energize same and illuminate the interior of said mailbox.

11. The mailbox lighting system of claim 10 further comprising a solar cell that generates electrical energy when light impinges on said solar cell, said solar cell being mounted exterior to said mailbox.

12. The mailbox lighting system of claim 11 wherein said means for storing electrical energy stores electrical energy generated by said solar cell.

13. The mailbox lighting system of claim 12 wherein said means for storing electrical energy comprises a rechargeable battery.

14. The mailbox lighting system of claim 13 further comprising isolation means connected between said solar cell and said means for storing electrical energy to permit electrical energy to flow from said solar cell to said means for storing electrical energy, while preventing electrical energy from flowing back to said solar cell.

* * * * *